US012497721B1

(12) United States Patent
Coon et al.

(10) Patent No.: US 12,497,721 B1
(45) Date of Patent: Dec. 16, 2025

(54) AUTOMATED SHEARING SYSTEM AND METHODS OF USE THEREOF

(71) Applicant: Shaw Industries Group, Inc., Dalton, GA (US)

(72) Inventors: Jeffrey Thomas Coon, Dalton, GA (US); Conrad Layson Fernandez, Jr., Dalton, GA (US); Austin Patrick, Dalton, GA (US)

(73) Assignee: Shaw Industries Group, Inc., Dalton, GA (US)

( * ) Notice: Subject to any disclaimer, the term of this patent is extended or adjusted under 35 U.S.C. 154(b) by 0 days.

(21) Appl. No.: 18/654,292

(22) Filed: May 3, 2024

Related U.S. Application Data

(60) Provisional application No. 63/499,867, filed on May 3, 2023.

(51) Int. Cl.
*D06C 13/00* (2006.01)
*D06C 13/08* (2006.01)
*D06H 7/00* (2006.01)

(52) U.S. Cl.
CPC ..... *D06C 13/00* (2013.01); *D06C 13/08* (2013.01); *D06H 7/00* (2013.01)

(58) Field of Classification Search
CPC ..... D06C 13/00; D06C 13/04; D06C 13/06; D06C 13/08; D06C 23/02; D06C 13/02; D06C 27/00; D06C 2700/29; D06C 2700/31; D06H 7/00; D06H 7/14; D06H 7/16; D06H 3/08; D06H 3/10
USPC ..... 26/15 R–16
See application file for complete search history.

(56) References Cited

U.S. PATENT DOCUMENTS 1,822,374 A * 9/1931 Richardson ..... D06C 13/02 26/17
1,978,989 A * 10/1934 Coolidge ..... D06C 13/02 26/17
2,084,300 A * 6/1937 Richardson ..... D06C 13/00 26/17
3,683,468 A * 8/1972 Kaufman ..... D06C 13/00 26/15 R (Continued)

FOREIGN PATENT DOCUMENTS

DE 3643297 A1 * 6/1988 ..... G01N 33/367
GB 716204 A * 9/1954 ..... D06C 13/00

(Continued)

OTHER PUBLICATIONS

English Translation KR 20090089067 (JE); doc published Aug. 21, 2009. (Year: 2009).*

*Primary Examiner* — Amy Vanatta
(74) *Attorney, Agent, or Firm* — Smith Gambrell & Russell LLP

(57) ABSTRACT

The invention is directed towards an automated shearing system for shearing a carpet from a first height to a desired height. Such system may include a number of pile height sensors, control units, shear heads, motors, and databases. The system determines how much carpet can be sheared by each shear head and actuates the shear head accordingly. Shearing a carpet to a desired height may require about one up to about three passes through the system. Methods of measuring a carpet, determining how much to shear the carpet, and shearing the carpet are included.

27 Claims, 7 Drawing Sheets

(56) References Cited

U.S. PATENT DOCUMENTS

| | | | | | |
|---|---|---|---|---|---|
| 3,969,797 | A * | 7/1976 | Riedel | ..... | D06C 13/02<br>26/17 |
| 2018/0216264 | A1 * | 8/2018 | Hup | ..... | D06C 15/02 |

FOREIGN PATENT DOCUMENTS

| | | | | | |
|---|---|---|---|---|---|
| GB | 1146255 | A * | 3/1969 | ..... | D06C 13/00 |
| KR | 20090089067 | A * | 8/2009 | ..... | D06C 13/00 |

* cited by examiner

AUTOMATED SHEARING SYSTEM AND METHODS OF USE THEREOF

CROSS-REFERENCE TO RELATED APPLICATIONS

This invention claims priority from U.S. Provisional Patent Application Ser. No. 63/499,867, filed May 3, 2023, which is incorporated by reference in their entirety herein.

TECHNICAL FIELD OF THE INVENTION

The present disclosure relates to automated shearing systems for shearing carpet and methods of use thereof.

BACKGROUND OF THE INVENTION

Carpet products are capable of being tufted in loops and subsequently cut (e.g., sheared) to desired heights based on product designs. Cutting carpets to desired heights allows for various textures, colors, and other characteristics.

Current shearing systems and methods use hydraulic-actuated shearing heads. Such systems and methods suffer from imprecise blade positioning, leading to inconsistencies in carpet products. Further, these systems are physically hard to adjust. Additionally, adjustment of shearing heads is currently performed by auditory observation where an operator listens to the shearing system to determine how much carpet the shearing head is cutting. Therefore, such shearing heads are inaccurate, indefinite, and difficult to adjust, placing a carpet product at risk of damage. This can make it difficult to know how much carpet is being sheared until shearing begins.

Traditional methods require a number of passes through a shearing system (about two to about four) to produce a final carpet due to the heating of shearing blades due to friction during shearing, which can melt a carpet. Typically, a single shear head cannot shear more than about 1.6 mm of carpet at a time. After each pass, carpets are loaded onto a trailer until the trailer has been substantially filled. Then, all carpets are moved back to the beginning of the shear system, and sheared again. Based on this process, it can take approximately one day per pass per roll. This process is time intensive.

Therefore, there is a need for a system and method to address the issues described above.

SUMMARY OF THE INVENTION

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

The present disclosure relates to an automated shearing system for shearing a carpet from a first height to a desired height. The system includes drive rollers which the carpet is threaded through to make a continuous flow of carpet, at least one shear head positioned along the shear machine to cut the carpet to the desired height, at least one motor subsystem configured to adjust shear head height in relation to the carpet, at least one pile height sensor positioned along a moving support (e.g., a belt and/or number of rollers) before the shear head configured to measure the first height of the carpet, and at least one control unit configured to receive the heights of the carpet from the pile height sensor and to adjust the shear head height of the shear head to cut the carpet to the desired height. In such an aspect, the system is configured to shear the carpet to the desired height in about one up to about three passes.

In an aspect, the present disclosure relates to an automated shearing system including a plurality of shear heads positioned along the moving support (e.g., belt and/or number of rollers). The plurality of shear heads can include two or more shear heads. In such an aspect, the system further includes a plurality of pile height sensors positioned at least before each shear head. Such pile height sensors can also be positioned before and after each shear head such that the system can measure the carpet's height before and after each shear head. In such an aspect, the system further includes a plurality of motor subsystems configured to actuate each of the shear heads. A plurality of motor subsystems can include two or more motor subsystems, one for each shear head. Such motor subsystems include at least two motors coupled to each shear head, at each end, to adjust (i.e. actuate) each shear head's height. Such motors can be servo motors, though any such motor known in the art can be used, and can precisely and accurately adjust each shear head's height by as little as 0.001 mm.

The present disclosure relates to a system configured to determine a maximum amount of carpet to shear within a pass of a shear head without causing the carpet to melt. A shear head may cause a carpet to melt when shearing more than a maximum height of carpet due to friction-induced heat of a shear head. As a non-limiting example, a maximum height may be about 1.6 mm of carpet. In such an aspect, the system comprises at least one control unit configured to receive a measurement captured by each pile height sensor and to determine how much to adjust each shear head to cut the carpet to reach the desired height. In such an aspect, at least one, two, three, or more motor control units can be used. A control unit determines how much to adjust each shear head by comparing a measurement received from a first pile height sensor to both a maximum allowable shear amount and the desired carpet height. The present disclosure relates to a system including one or more databases. Such databases are configured to receive and store measurements taken by pile height sensors and values determined by control units of the system.

The present disclosure relates to a method for shearing a carpet to a desired height. Such method includes feeding a carpet into a system disclosed herein. Such method further includes taking a first measurement of a height of the carpet, determining an amount to shear from the carpet, wherein the amount is based upon the measured height and the desired height, feeding the determined amount to shear in terms of height to a motor and adjusting a height of a shearing head accordingly, and advancing the carpet within the system so the shearing blade shears the carpet. The amount to be sheared is determined by comparing the first measurement to the maximum allowable height of carpet to be removed by each shear head and the remaining height of carpet to be sheared to reach the desired carpet height. The determined amount will be the minimum of the two values. In aspects where the desired carpet height is not reached in one pass through the system, the carpet can undergo additional passes.

The present disclosure relates to methods of feeding a determined value to a pair of motors to actuate one or more shear heads. The present disclosure relates to methods where an additional, final shear is performed once a desired carpet height is reached. Such a shear does not remove a substantial amount of carpet and provides a clean finish to the carpet. In example aspects, one or more shear heads may substantially shear a carpet while a remaining, final shear head provides the clean finish.

BRIEF DESCRIPTION OF DRAWINGS

The features and components of the following figures are illustrated to emphasize the general principles of the present disclosure. Corresponding features and components throughout the figures can be designated by matching reference characters for the sake of consistency and clarity.

DETAILED DESCRIPTION OF THE INVENTION

Figure 1:
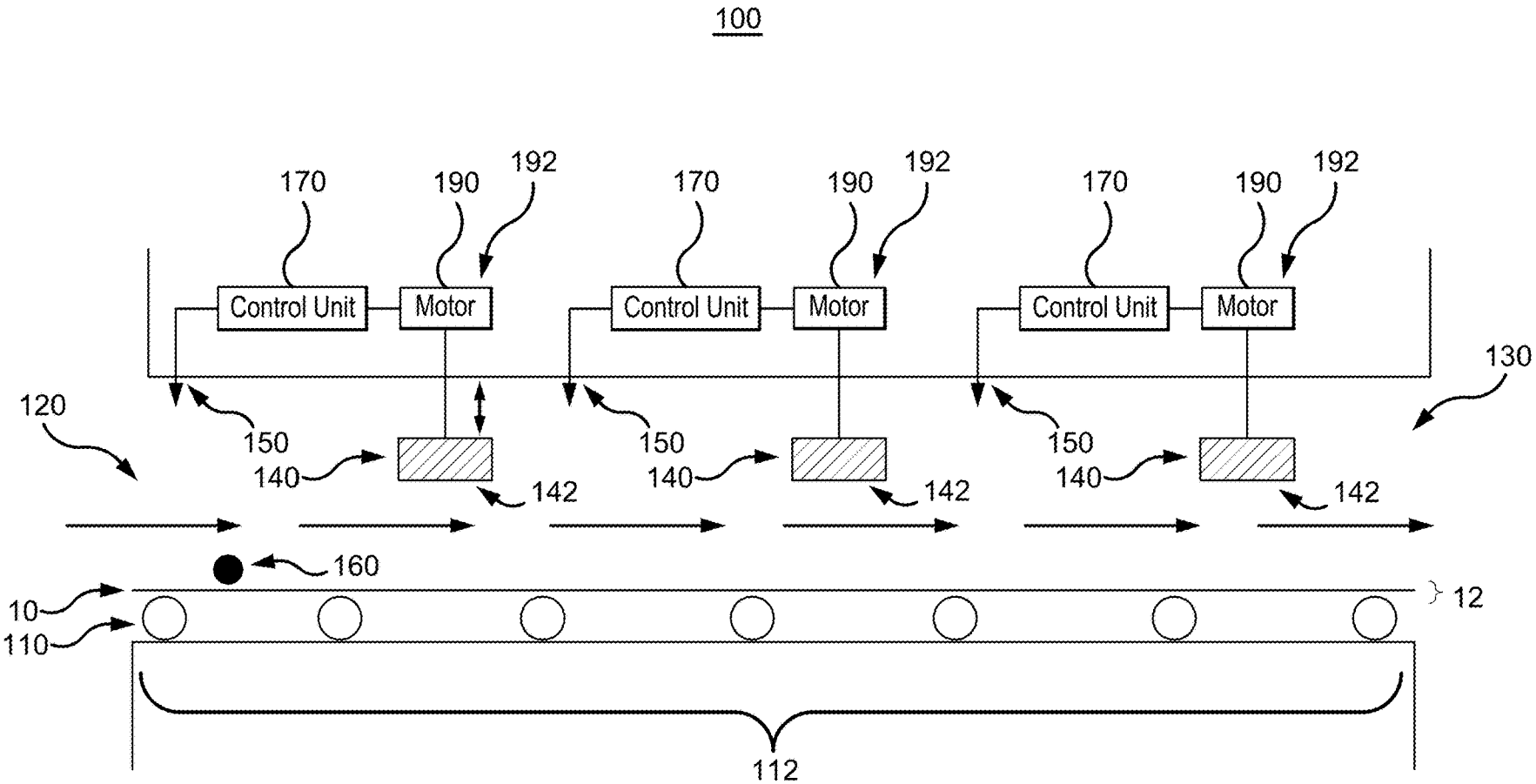
FIG. 1 depicts an example system for shearing carpet according to the present disclosure.

It should be appreciated that this disclosure is not limited to the systems, components, and methods described herein. It is also to be understood that the terminology used herein is for the purpose of describing certain embodiments only, and is not intended to be limiting, since the scope of the present disclosure will be limited only by the appended claims.

Unless defined otherwise, all technical and scientific terms used herein have the same meaning as commonly understood by one of ordinary skill in the art to which this disclosure belongs. Any systems, components, and methods similar or equivalent to those described herein can be used in the practice or testing of the present invention. All publications mentioned are incorporated herein by reference in their entirety.

The use of the terms "a," "an," "the," and similar referents in the context of describing the presently claimed invention (especially in the context of the claims) are to be construed to cover both the singular and the plural, unless otherwise indicated herein or clearly contradicted by context.

Recitation of ranges of values herein are merely intended to serve as a shorthand method of referring individually to each separate value falling within the range, unless otherwise indicated herein, and each separate value is incorporated into the specification as if it were individually recited herein.

Use of the term "about" is intended to describe values either above or below the stated value in a range of approx. +/−10%; in other embodiments the values may range in value either above or below the stated value in a range of approx. +/−5%; in other embodiments the values may range in value either above or below the stated value in a range of approx. +/−2%; in other embodiments the values may range in value either above or below the stated value in a range of approx. +/−1%. The preceding ranges are intended to be made clear by context, and no further limitation is implied. All methods described herein can be performed in any suitable order unless otherwise indicated herein or otherwise clearly contradicted by context. The term "example" as used herein refers to an aspect, embodiment, feature, or the like that is intended to serve as an example of a particular aspect, embodiment, feature, or the like of the present disclosure. "Example," as used herein is not intended to limit the disclosure in any way. The use of any and all examples, or example language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

The present disclosure can be understood more readily by reference to the following detailed description, examples, drawings, and claims, and their previous and following description. However, before the present systems, components, and methods are disclosed and described, it is to be understood that this disclosure is not limited to the specific systems, components, and methods disclosed unless otherwise specified, as such can, of course, vary. It is also to be understood that the terminology used herein is for the purpose of describing particular aspects only and is not intended to be limiting.

The present disclosure relates to systems and methods of use thereof for automated shearing of carpets. Carpets are sheared from an initial height to a desired height dependent on the design of the final carpet product. Final product designs are affected by the height to which the carpet is sheared where certain heights will produce various textures, colors, and other such properties. Automated shearing systems and methods disclosed herein increase consistency and precision of carpet shearing while reducing the time needed to produce the final carpet product.

I. Automated Shearing Systems and Sub-Systems

The present disclosure relates to an automated shearing system 100 for shearing a carpet 10 with a height 12, as shown in FIG. 1. In an aspect, the automated shearing system 100 moves carpet 10 along a moving support 110 (e.g., a belt or one or more rollers 110) to a head shear 140, the height of which is adjusted by a motor subsystem 190 based upon the measurements of the height of the carpet 10, captured by a pile height sensor 150, and the head shear 140, which are used by a control unit 170 to determine the amount of adjustment to the head shear 140 in order to shear the carpet 10. As non-limiting examples, the automated shearing system 100 can shear a variety of carpet styles including carpets with tufted loops, cut loops, blends of loop styles, and any other carpet style known in the art. Carpet is a non-limiting example of a material. The automated shearing system 100 can shear a variety of materials outside of carpet including any fibrous material that needs to be sheared from a first height to a second height. The present disclosure relates to an automated shearing system 100 including a belt or a number of rollers 110 for a carpet 10 to rest on as it progresses from an entry point 120 through the system 100 and to an exit point 130. The automated shearing system 100 shears a carpet 10 to reduce the carpet height 12 from an initial height 14 to a desired height 16 through a number of passes through the system 100. As non-limiting examples, achieving the desired height 16 may require one pass through the system 100. As further non-limiting examples, it may require two, three, or more passes through the system 100.

The present disclosure relates to at least one adjustable shear head 140 positioned along the belt/number of rollers 110. A shear head 140 includes a shearing blade 142 coupled to the shear head 140. Shearing blades 142 may be selected from a variety of blades appropriate for shearing materials disclosed herein. As non-limiting examples, shearing blades 142 may be straight-edged blades, spiral blades, or any other suitable blade known in the art. The shear head 140, and the attached shearing blade 142, is capable of being actuated up and down in order to shear different amounts of the carpet height 12 as the carpet 10 moves through the system 100. Actuation is achieved through the use of motors, as discussed further below. More than one shear head 140 can be positioned along the belt/number of rollers 110 in order to shear a carpet 10 multiple times as the carpet 10 progresses through the system 100. As a non-limiting example, two, three, four, or more shear heads 140 can be positioned along the belt/number of rollers 110. Traditionally, shearing systems have included four shear heads 140. In such instances, not all shear heads 140 are engaged and actively shearing carpet 10. The present disclosure relates to methods of engaging multiple shear heads 140 per pass to increase efficiency, as discussed further below.

Friction between the carpet 10 and shear head 140 occurs as the shear head 140 shears the carpet. As a result, shear heads 140 increase in temperature during carpet shearing. If the temperature of a shear head 140 becomes overly elevated, the fibers of a carpet 10 will melt during shearing, ruining the carpet 10. According to an aspect, in order to prevent such melting, each individual shear head 140 shears a maximum of around 1.6 mm of a carpet's height 12 per pass through, although more or less of a carpet's height 12 may be sheared depending on a number of factors. Such factors include changes in carpet material, the material and/or morphology of the shearing blade 142, and the like and use of lubricants, coolants, and the like. In such an aspect with a maximum of around 1.6 mm, three shear heads 140 would be able to shear a maximum combined amount of about 4.8 mm of a carpet's height 12 per pass.

Additionally, each shear head 140 of a system 100 can be coupled to an oiler (not pictured). An oiler releases oil, including but not limited to, a light-weight blade oil as known in the art, onto a shear head 140 to prevent overheating. In an example aspect, oil may be released in between passes of carpet shearing. In an additional, example aspect, oil may be released at continuous intervals throughout carpet shearing. In such an example aspect, oil may be released by an oiler coupled to a shear head 140 approximately every 20 seconds while a carpet 10 is passing through to reduce the shear head's temperature. Other intervals are possible and can be used according to the application. In additional aspects, intervals of about every 2 seconds, about every 5 seconds, about every 10 seconds, about every 15 seconds, about every 25 seconds, and about every 30 seconds can be used. Oilers are specially designed to release enough oil to lower the shear head's temperature to prevent melting while also not releasing too much oil. Releasing too much oil may stain a carpet 10, ruining the product.

The present disclosure relates to at least one pile height sensor 150 configured to be used in the system 100 and placed at the entry point 120. Pile height sensors 150 include a variety of such sensors 150 capable of measuring various heights of carpet piles, as disclosed herein. Non-limiting examples of such pile height sensors 150 include any laser measuring system (e.g., a laser) capable of taking accurate measurements to allow precise and accurate actuation of one or more shear heads 140, as described herein. As non-limiting examples, measurements may be taken at around 10 microns of resolution and with at least 1,000 measurement points across a 12-foot width. Additional resolutions, measurement points, and widths of carpets 12 are capable of being used within systems and methods described herein. As a non-limiting example, carpets 12 with widths from about 2 feet up to about 18 feet may be used. Additional pile height sensors 150, including acoustic sensors, video cameras coupled with imaging software, and the like, may be used beyond laser-based sensors.

Figure 2:
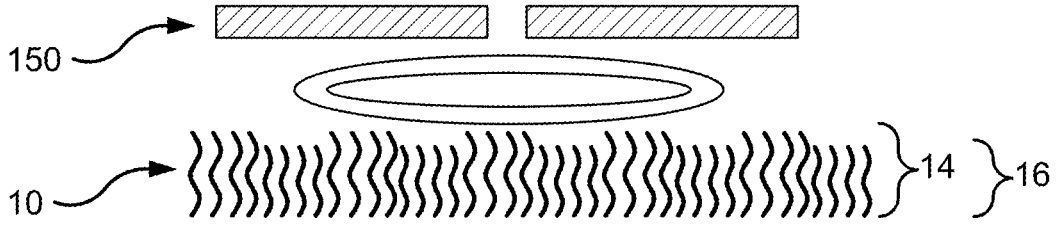
FIG. 2 depicts a non-limiting example using capacitor plates as pile height sensors according to the present disclosure.

As a non-limiting example, capacitor plates 150 may serve as pile height sensors, as shown in FIG. 2. In such an example, capacitance changes as the capacitor plates get closer to a carpet. The capacitor plates 150 are raised or lower to a measured distance until a threshold capacitance is reached where the top of the carpet barely touches the capacitor plates.

Figure 3:
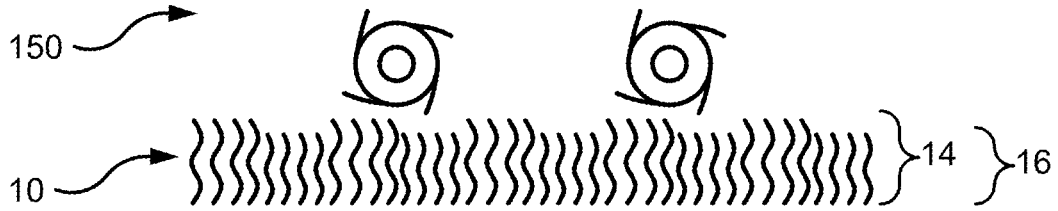
FIG. 3 depicts a non-limiting example using a number of brushes as pile height sensors according to the present disclosure.

In an additional non-limiting example, brushes 150 may serve as pile height sensors, as shown in FIG. 3. In such an example, one or more brushes 150 may be attached to a motor (not shown) and used to detect the top of a pile of carpet. When such brushes spin, a motor generates a voltage, such as a DC voltage. As the brushes reach the top of the carpet pile, the voltage will approach approximately 0 Volts, such as 0 Volts DC. By setting a threshold value of approximately 0 Volts, such as approximately 0 Volts DC, in a control unit, the brushes 150 can thus allow the shear head 140 to be actuated to the top of the pile height. Such an example brush 150 and motor assembly can be disposed on a linear actuator to allow the distance to the top of the carpet pile to be measured.

A pile height sensor 150 measures the height 12 of a carpet 10 as it enters the system 100. The system 100 may also include a plurality of additional pile height sensors 150 along the length 112 of the belt/number of rollers 110, as discussed further below. Pile height sensors 150 positioned further along the system 100 measure the height of the carpet 12 at any point along the belt/number of rollers 110 where the pile height sensors 150 are positioned. As a non-limiting example, additional pile height sensors 150 may be positioned before each shear head 140 in the system 100. In such an example, each pile height sensor 150 measures the height of the carpet 12 before the carpet 10 passes each shear head 140. In a further example, additional pile height sensors 150 may be positioned after each shear head 140. In such further aspect, each pile height sensor 150 positioned after each shear head 150 measures the height 12 of a carpet 10 as the carpet 10 moves past each shear head 140. In such examples, the system 100 can use pile height sensors 150 to measure the initial height 14 of a carpet 10 entering the system 100, as well as the height 12 of the carpet before and after each shear head 140.

The present disclosure relates to addressing drawbacks associated with configurations using pile height sensors 150 to ultimately actuate shear heads 140. Though the concept of using sensors 150 to determine the actuation of shear heads 140 may be conceptually simple, the reduction of the concept proved more difficult than anticipated. The disclosure requires precise and accurate actuation of shearing heads 140, as disclosed herein, to produce various patterns and designs associated with various stock keeping units (SKUs) of carpet and other similar products. This requires pile height sensors 150 to also be capable of taking accurate and precise measurement of carpet heights to be used in determining shear head 140 actuation. However, pile height sensors 150 (e.g., lasers) are affected by vibrations and mechanical forces associated with overall shearing systems to which sensors 150 are coupled. Such vibrations and forces may cause noise in sensor data, which in turn can decrease the accuracy and precision of actuation of shear heads 140.

The present disclosure also relates to reducing vibration-induced noise in sensors 150 through use of noise cancelling programs. In such an aspect, data collected from a sensor 150 can be fed into a noise cancelling software or program to substantially remove noise caused by vibrational forces within a system 100. In a particular, non-limiting example, noise may be able to be efficiently removed if it is occurring in a repeating frequency. However, in some aspects, given the nature of the shearing machine and the relationship with the belt/number of rollers and product (e.g., carpet moving along said belt/rollers), the vibration can be non-uniform and occurring at varying frequency. In other examples, noise not adhering to a set frequency can also be removed.

The present disclosure relates to addressing drawbacks relating to vibration-induced noise in sensors 150. Sensors 150 can be placed in optimized locations where vibrational forces from a shearing system are minimized, as to reduce vibrational forces affecting a sensor 150. In an aspect, the sensors 150 can be placed and secured outside of the shearing enclosure itself. As a non-limiting example, sensors 150 may be placed at least two feet away from carpet to allow mounting outside of a shearing machine enclosure. Additionally, sensors 150 may be coupled to portions of a shearing system 100 that are known to be more rigid or resistant to vibrational forces caused by shearing within a system 100. Mounting a sensor 150 at any location within a system 100, and not at a location optimized to experience minimal vibrational forces, will decrease the quality of a final sheared product. Sensors 150 may also be mounted within a system 100 using a rigid mount to reduce vibrational noise. In some aspects, the sensors 150 can be mounted on or to structures that are not part of the shearing system 100 itself in order to eliminate such vibrational noise. However, such locations must still have a field of vision that includes the carpet as it is sheared within the shearing system 100. As non-limiting examples, such locations may include structural supports above a shearing system 100, such as rafters or crossbars, as well as structural supports adjacent and/or near shearing systems 100, such as support columns or other nearby structures.

Figure 4:
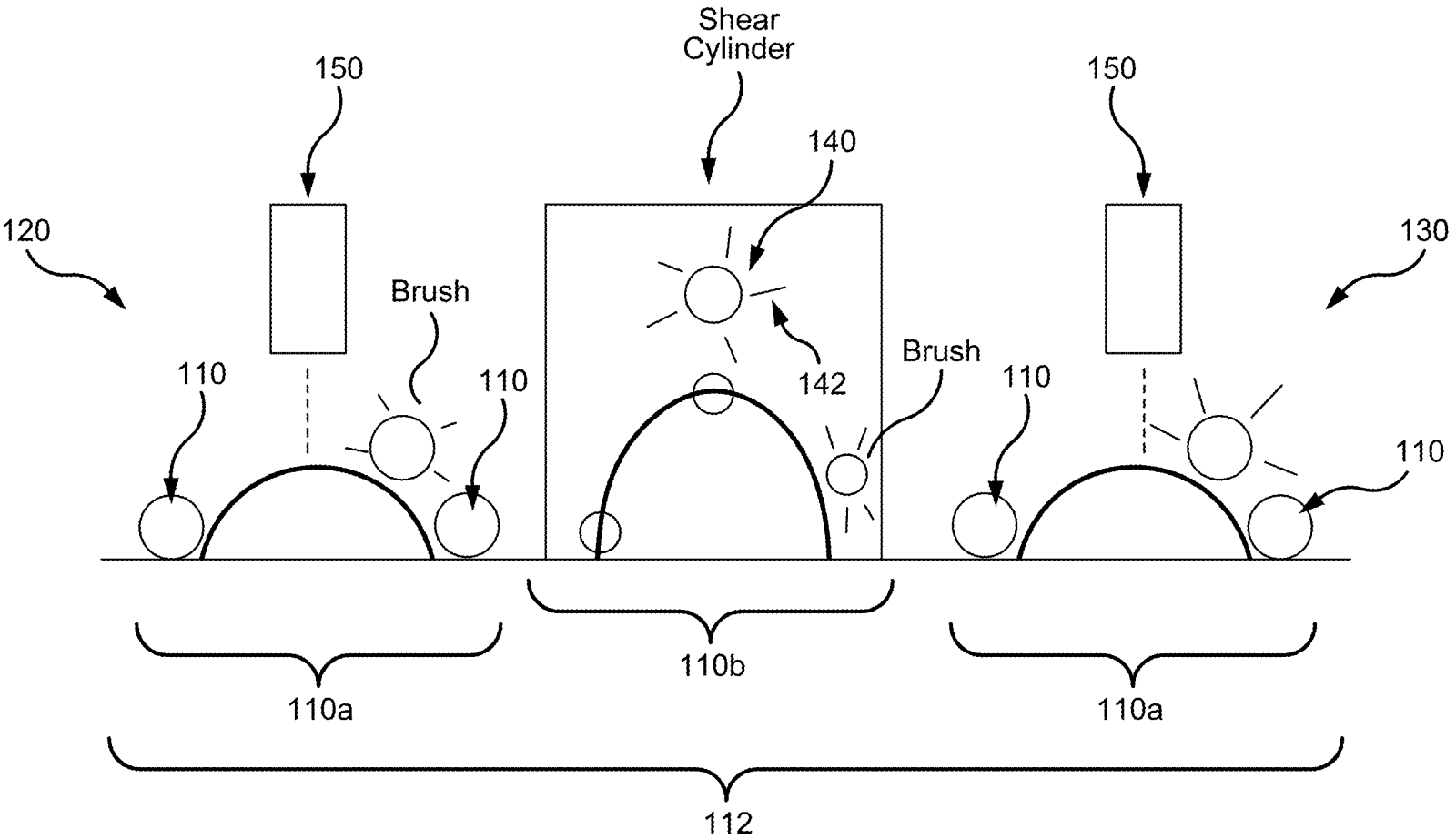
FIG. 4 depicts a non-limiting example of a vibration-reduced aspect of a system according to the present disclosure.

The present disclosure also relates to reducing vibration-induced noise in sensors 150 by providing stabilized portions 110*a* of belts/rollers 110 a system 100, as shown in FIG. 4. In such an example, a product may pass under a shear head 140, being sheared as described herein. The product having been sheared can then move to a stabilized portion 110*a* of belts/rollers 110 of a system 100. As a non-limiting example, such a stabilized portion 110*a* of belts/rollers 110 may be supported by a concrete slab, a metal table, a reinforced material, or any such material or structure capable of resisting vibrational forces received from shearing within a system 100. While moving on a stabilized portion 110*a* of belts/rollers 110, the product will receive less vibrational forces. A sensor 150 positioned above a stabilized portion 110*a* of belts/rollers 110 will also receive less vibrational forces. The combined effect of reduced vibrations affecting both a product and a sensor 150 will allow pile height measurements of greater accuracy and precision to be received. Such enhanced measurements facilitate improved accuracy and precision of actuation of shear heads 140. In a non-limiting example, a carpet 10 may pass over a less stabilized portion 110*b* of belts/rollers 110 a system 100 while being sheared before passing over a stabilized portion 110*a* of belts/rollers 110 of the system 100 while being measured by a sensor 150 before then passing over a less stabilized portion 110*a* of belts/rollers 110 again while being sheared and so on until a carpet has been sheared to a desired height 16 or has ended a pass through a system 100. This allows patterns and designs of various SKUs to be accurately produced according to the present disclosure.

The present disclosure additionally relates to a nose bar 160 at the entry 120 of the system 100, as shown in FIG. 1. The nose bar 160 presses the bottom of the carpet 10 to maintain a flat surface on the moving support 110. The nose bar 160 also maintains contact with the carpet 10 and other components of the system 100, as discussed further below.

The present disclosure additionally relates to at least one control unit 170. As non-limiting examples, a system 100 may include more than one control 170 unit including but not limited to two, three, four, or more control units. A control unit 170 is configured to receive measurements, such as measurement data, of carpet height 12 taken by pile height sensors 150. A control unit 150 then uses the measurement data to determine an amount of carpet to be removed by a shear head 140, and to then call upon the motor subsystem 190 to adjust the height of the shear head 140 accordingly (i.e., to actuate the shear head 140). This amount is determined by comparing the measurement of the carpet height 12 taken by a pile height sensor 150 to a first and a second value. A first value includes the maximum amount of carpet that a shear head 140 can remove. As discussed above, this value may equal about 1.6 mm of carpet height 12 per shear head 140 to avoid carpet melting. A second value includes the remaining amount of carpet height 12 to be removed to achieve a desired carpet height 16. As a non-limiting example, a carpet 10 with a height 12 of about 8 mm, as measured by a pile height sensor 150, and a desired height 16 of about 7 mm will have a second value of about 1 mm. A variety of control units 170 known in the art can be used in the system 100. As a non-limiting example, a programmable logic controller (PLC) can be used. Control units 170 must be quick enough to not delay the system 100.

Figure 5:
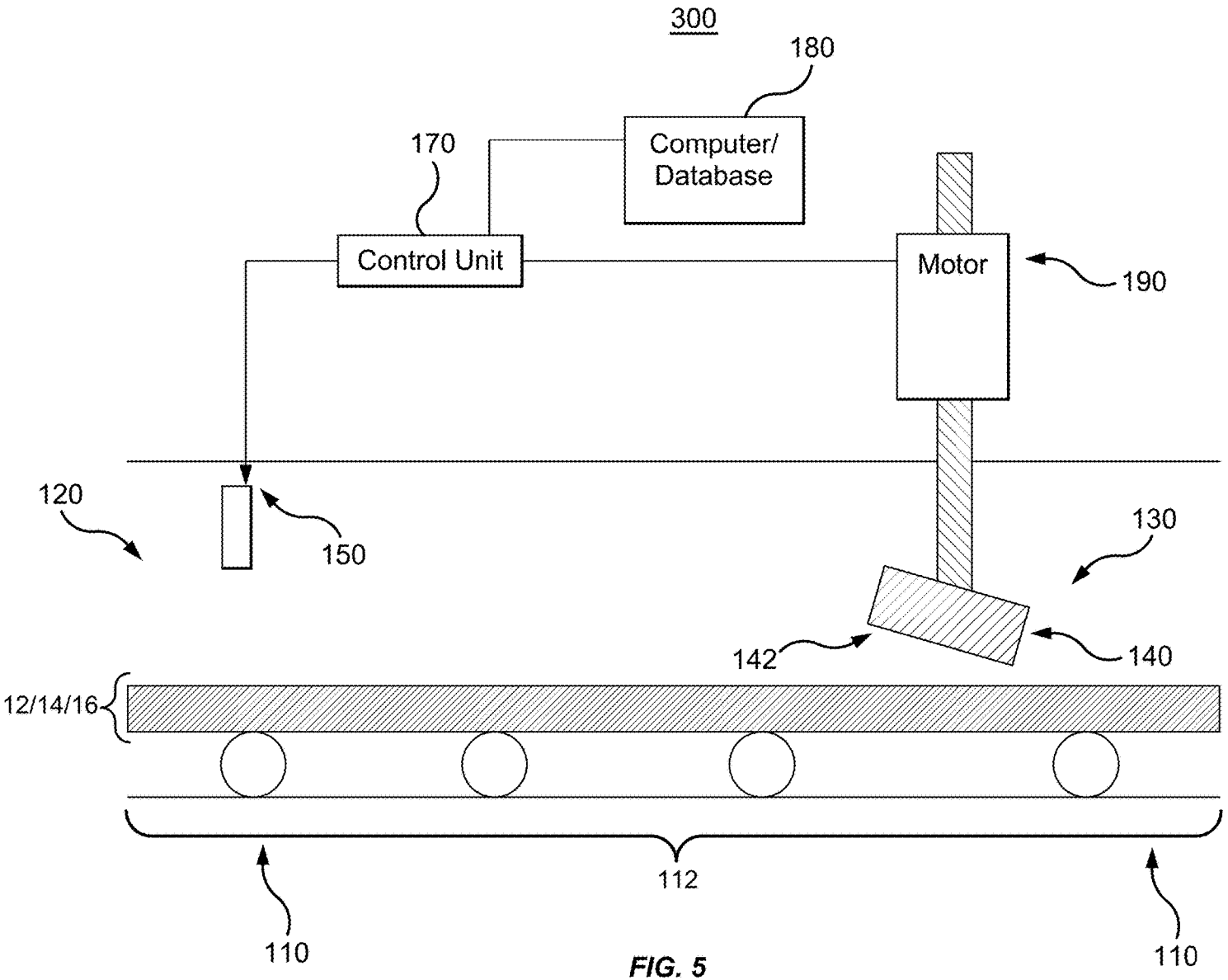
FIG. 5 depicts an example sub-system for shearing carpet according to the present disclosure.

The present disclosure relates to at least one database 180 (see, e.g., FIG. 5). A database 180 is configured to receive measurements from both pile height sensors 150 and control units 170 of the system 100. As non-limiting examples, a database 180 may receive and store measurements of carpet height 12 from pile height sensors 150 and values of carpet to be sheared determined by control units 170. A database 180 may also receive and store initial heights 14 and desired heights 16. Databases 180 may allow data sets to be created that can be used for machine learning. Such data sets may also function as repositories for a running history of a system 100.

The present disclosure additionally relates to at least one motor subsystem 190. A motor subsystem 190 is coupled with a shear head 140 as to actuate the shear head 140. A motor subsystem 190 receives a determined value from a control unit 170 and actuates a shear head 140 accordingly. The shear head 140 is actuated up and down where downward actuation will cause the shear head 140 to shear a larger amount from a carpet 10. Upward actuation will decrease the amount sheared from a carpet 10. A motor subsystem 190 is capable of actuating a shear head 140 up or down precisely and accurately. Such actuation may be precisely and accurately actuated in increments as little as about 0.001 mm. In an aspect, the motor subsystem 190 is also configured to report to the control unit 170 the current height of the shear head 140, which can then be used to calculate the actual height adjustment needed to move the shear head 140 up or down to shear the desired amount of carpet 10.

A motor subsystem 190 includes at least two motors. Motors can be selected from any motors known in the art capable of actuating an implement up and down including but not limited to servo motors. As non-limiting examples, a system 100 may include more than one motor subsystem 190 including but not limited to one, two, three, four, or more motor subsystems 190. In such examples, each motor subsystem 190 is coupled to a shear head 140. This allows each shear head 140 to be individually actuated as determined by a control unit 170 while a carpet 10 progresses through a system 100.

The present disclosure relates to a variety of combinations of components disclosed above. Such combinations may form a subsystem 300, as shown in FIG. 5. As a non-limiting example, a subsystem 300 is capable of measuring a carpet height 12, determining an amount of carpet to be sheared, and actuating a shear head 140. In such an example, a subsystem 300 includes at least one pile height sensor 150. The at least one pile height sensor 150 measures the height 12 of a carpet 10 and feeds the measurement to a control unit 170. The control unit 170 determines an amount of carpet to be sheared, as disclosed herein, and feeds the amount to a motor subsystem 190. The motor subsystem 190 then actuates a shear head 140. The shear head 140 can be actuated up or down or left in its current position.

The present disclosure relates to a number of additional subsystems 310. As a non-limiting example, an additional subsystem 310 may include multiple subsystems 300, as described above. An additional subsystem 310 may include more or less components as described in subsystem 300. In such example, an additional subsystem 310 may also include a pile height sensor 150 after a shear head 140. In a further such example, an additional subsystem 310 may include more than one motor subsystems 190.

The present disclosure additionally relates to an example automated shearing system 100 including components disclosed herein. Such example system 100 includes a moving belt/number of rollers 110 on which a carpet 10 may be disposed where the carpet 10 moves along said belt/rollers 110 through the machine. The example system 100 also includes an entry point 120, an exit point 130, and a nose bar 160 positioned near the entry point 120. The system 100 further comprises a first pile height sensor 150 positioned at the entry point 120 to measure the initial height 14 of a carpet 10 entering the system 100. The system additionally includes at least three shear heads 140 positioned along the number of rollers 110. Such shear heads 140 can be positioned roughly equidistantly along the number of rollers 110, though this is not required. At least two of the at least three shear heads 140 substantially shear the carpet 10. Substantially shearing includes removing an amount of carpet greater than would be removed in a finishing (i.e. cleaning) shear. Finishing shears remove minor amounts of carpet to remove imperfections and give the final product a clean look. A remaining shear head 140 of the at least three shear heads 140 is configured to provide a finishing shear, as to produce a clean finish.

Each shear head 140 of the system 100 includes additional pile height sensors 150 positioned before and after each shear head 140 to measure the height 12 of a carpet 10 before and after passing each shear head 140. The system 100 further includes at least three control units 170 to receive measurements from pile height sensors 150 and to determine how to actuate each shear head 140, as disclosed herein. The determined amount of carpet to be sheared is fed to at least three motor subsystems 190. Each motor subsystem 190 actuates one of the shear heads 140 according to the amount determined by each control unit 170. The system 100 further includes at least one database 180 (e.g., stored on a computer and in communication with the control unit 170 as shown in FIG. 5) configured to receive and store carpet heights 12 measured by pile height sensors 150 including initial heights 14, as well as desired height values 16. A database 180 is further configured to receive and store determined shear amount values from control units 170.

Many additional systems 100 with varied quantities and combinations of components disclosed herein are capable of being configured and are contemplated by the present disclosure.

II. Methods of Use of Automated Shearing Systems

The present disclosure relates to a method of using automated shearing systems and subsystems, as disclosed herein. Such methods increase consistency and precision of carpet shearing while reducing the time needed to produce the final carpet product. A roll of carpet typically begins at about 8 mm up to about 9 mm in height and is sheared to about 6 mm up to about 7 mm in height, though other measurements are possible. The desired end height of the carpet is dependent on the carpet itself and the ultimate desired appearance of the product. Such parameters are known, and are traditionally stored via stock keeping unit (SKU). Traditional shearing systems may use four shearing heads, though not all shearing heads are typically engaged at one time. This may result from traditional shearing systems inability to accurately and precisely actuate shearing heads to prevent burning up or damaging shearing heads from shearing too much carpet. This drawback of traditional systems is addressed by systems and methods according to the present disclosure. In such an example, one shearing head may remove substantial amounts of carpet per pass. An additional shearing head is then capable of being engaged to provide a clean look to the carpet if all substantial shearing is completed. Alternative methods omitting a final, cleaning shearing head are additionally possible. Producing a final carpet product with the desired characteristics by traditional shearing methods may require about two to four passes through a system. Any reduction of passes increases the efficiency of the process of shearing. For example, as little of a reduction of 5% in the number of passes can lead to an approximate savings of 40 hours of operation per year, which can lead to an annual average savings of $40,000 for each re-shear line.

Methods and systems disclosed herein allow for additional shearing heads to be engaged such that the engaged shearing heads substantially shear the carpet passing underneath. These heads are actuated with increased precision and accuracy compared to hydraulic-actuated shearing methods in the prior art. An additional head may be engaged to provide a clean look to the carpet product. This greatly increases shearing efficiency and reduces the number of needed shear passes to about one to about three passes. As a non-limiting example, a system with three shearing heads may be configured for two heads to remove substantial portions of a carpet while the remaining head provides a finishing shear for a clean finish. In such an example, a carpet may be sheared from start to finish in only one pass. Such increased efficiency saves roughly one to two days of service time per week.

Figure 6:
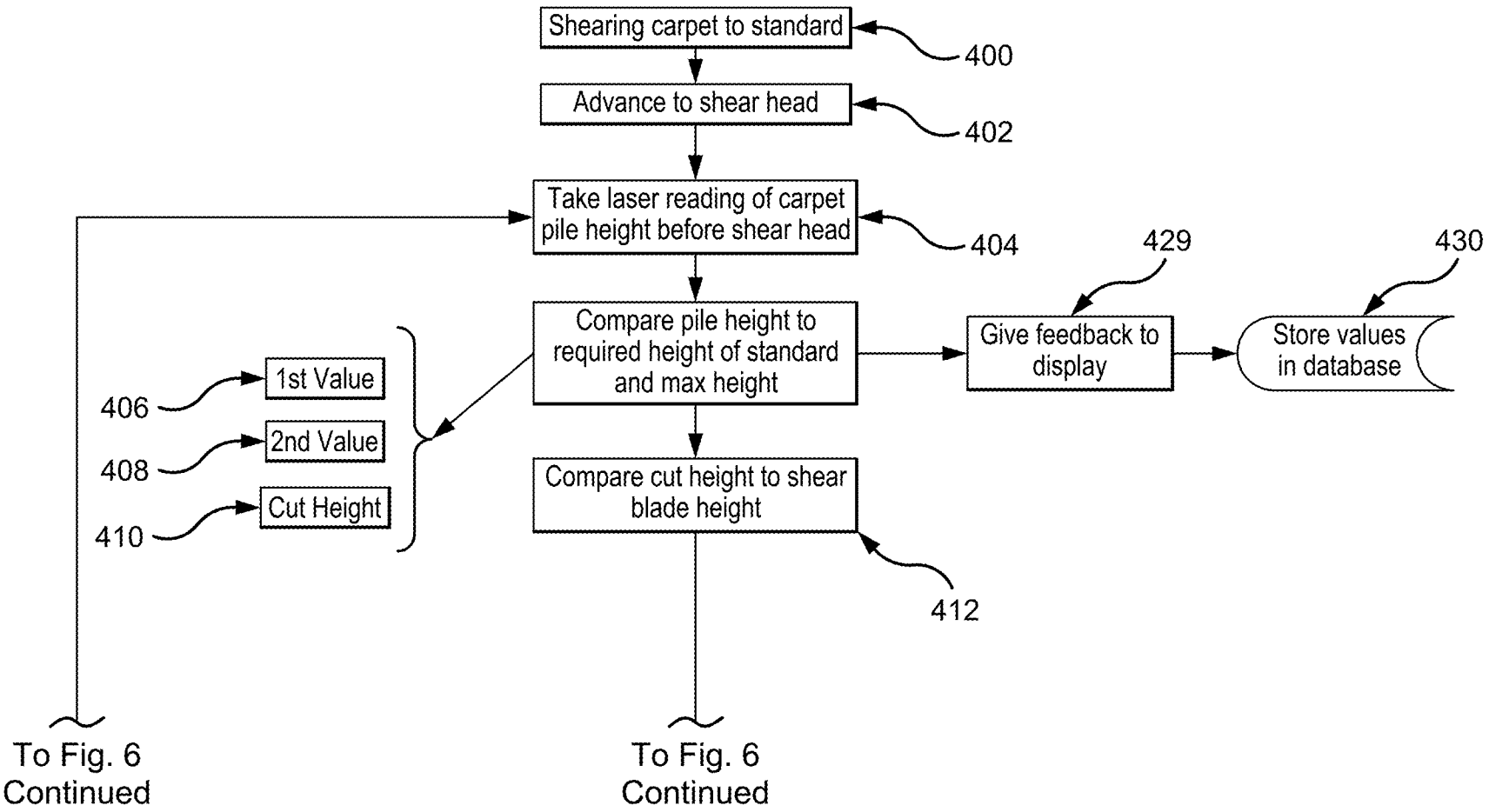
FIG. 6 depicts an example overall method according to the present disclosure.
Figure 6:
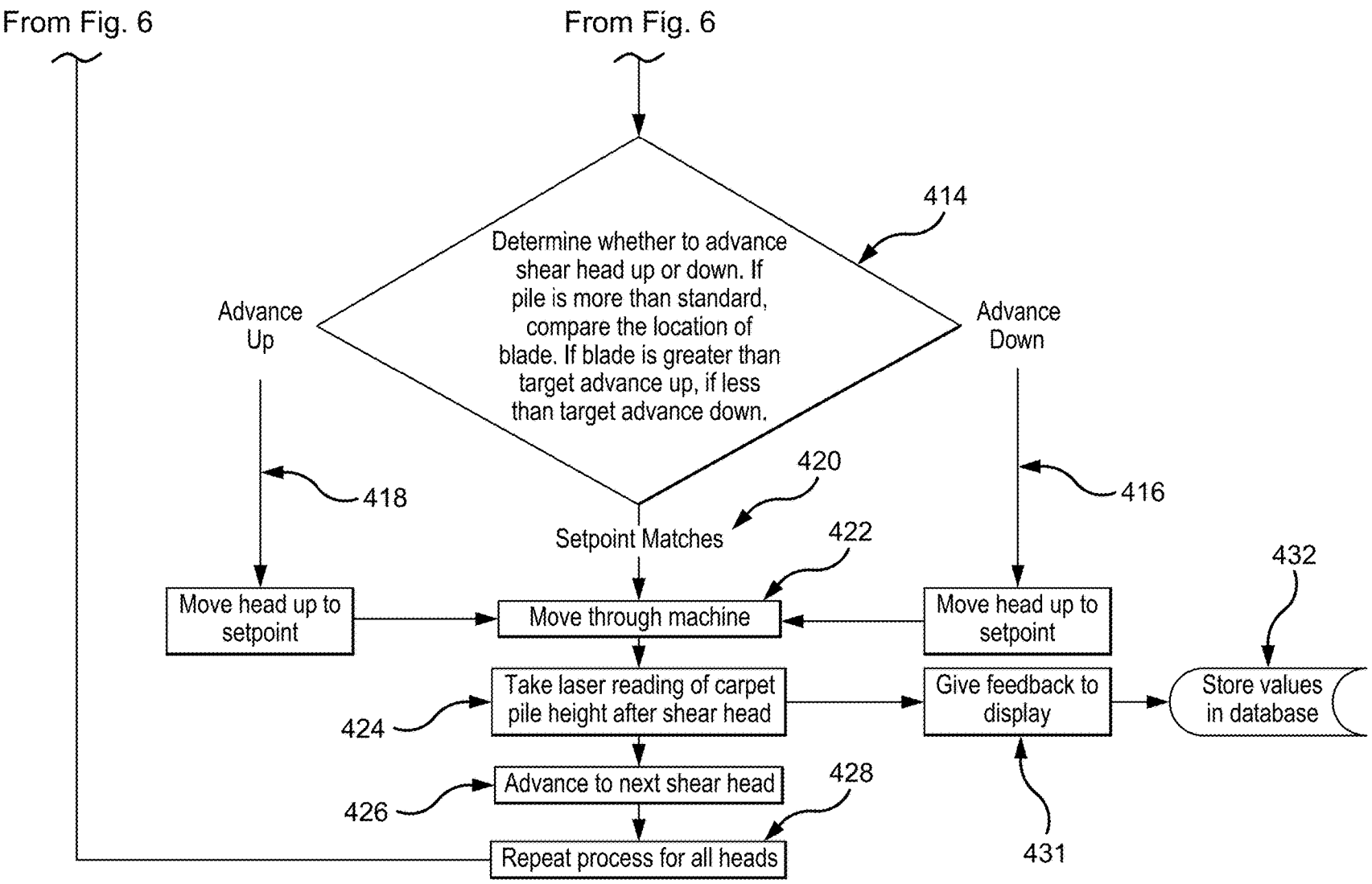

The present disclosure relates to a method of automated carpet shearing 400, as shown in FIG. 6. In such a method, a carpet to be sheared is placed into an automated shearing system, as disclosed herein. As the carpet advances to a shear head (step 402), a first reading of the carpet height is taken (step 404). This measurement may be taken as the carpet enters the system (e.g., a pile height sensor adjacent the opening of the system) or right before the shear head. As the carpet is advanced to a first shear head, a pile height sensor reads the carpet's height, and feeds this measurement to a control unit.

The control unit then compares this measurement to a first value (step 406) and a second value (step 408) to determine how much carpet to shear. The first value (step 406) is the maximum amount of carpet that the following shear head can remove. As previously discussed, this value may be limited by how much carpet a shear head can remove before melting occurs. In such an aspect, shear heads may be limited to shearing about 1.6 mm of carpet each before melting occurs. In an example aspect, a first value (step 406) may be about 1.6 mm. A second value (step 408) is the amount of carpet remaining to be sheared in order to achieve a desired carpet height. The second value is determined by subtracting the desired carpet height from the current carpet height (i.e. how much total carpet remains to be sheared). The control unit compares the two values to find the minimum of the two values (step 410). As a non-limiting example, if the first value (i.e. maximum amount the next shear head can remove) equals 1.6 mm and the second value (i.e. remaining amount to be sheared) equals 2.0 mm, the determined amount of carpet to be sheared by the next shear head will be 1.6 mm. In such an example, the next shear head will not shear more than the determined 1.6 mm to avoid melting. As a further non-limiting example, if the first value (i.e. maximum amount the next shear head can remove) equals 1.6 mm and the second value (i.e. remaining amount to be sheared) equals 0.6 mm, the determined amount of carpet to be sheared will be 0.6 mm. As a further non-limiting example, if the first value equals 1.6 mm and the second value equals 0.0 mm, the determined amount of carpet to be sheared will be 0.0 mm, and the subsequent shear head may be engaged to provide a finishing or cleaning shear.

Once the amount of carpet to be sheared is determined, the system then compares the determined cut height to the shear head height (step 412) to determine how to adjust the shear head (step 414). If the shear head is positioned too high to shear the amount determined, the shear head will be actuated down to shear more carpet (step 416). If the shear head is positioned too low to shear the amount determined, the shear head will be actuated up to shear less carpet (step 418). If the shear head is positioned at the correct height to shear the amount determined, the shear head will not be actuated in either direction (step 420). Once the shear head is correctly actuated (after step 416, 418, or 420), the carpet will progress through the machine and be sheared (step 422). The method described above occurs rapidly given the quick nature of all components disclosed herein. As a result, no additional delay occurs compared to prior art shearing methods.

Figure 7:
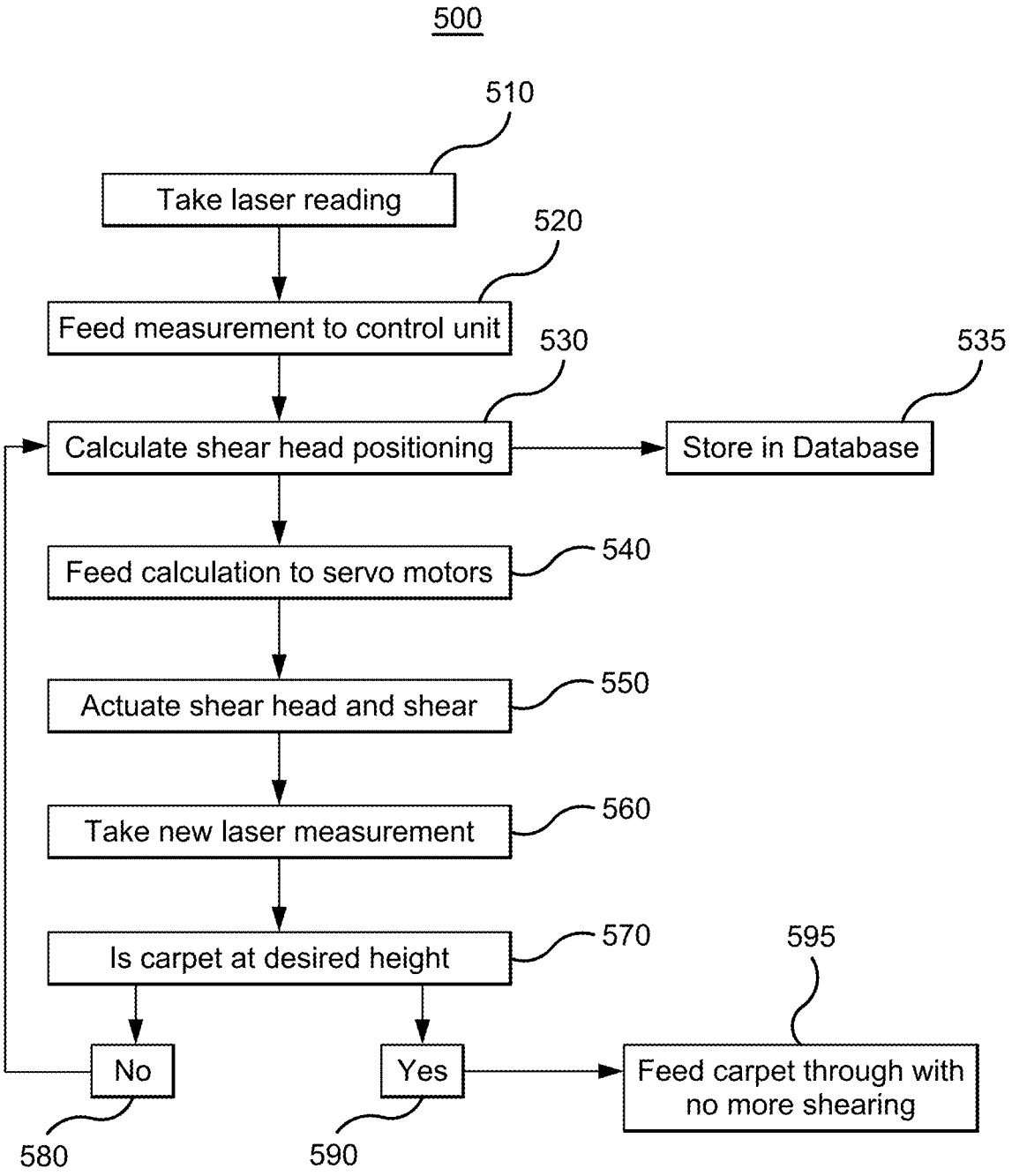
FIG. 7 depicts an example sub-method according to the present disclosure.

After passing through a shear head, the carpet's height is again measured by a pile height sensor positioned after the shear head (step 424). The carpet then advances to a next shear head (step 426), if the carpet has not passed the ultimate shear head. The method then repeats for each remaining shear head in the system (step 428). Additional shearing occurs at subsequent shear heads to reach desired product specifications, as shown in FIG. 7. If the carpet does not achieve desired product specifications after a singular pass through the system, it will be returned to the beginning of the system where the above methods will repeat until the carpet reaches its desired properties.

All values measured by pile height sensors and determined by control units are fed to one or more databases, which receive and store these values (see steps 430, 432 in FIG. 6). In addition, these values can be shared with a display as well (see steps 429, 431, and 433). Databases allow for the creation of datasets to facilitate machine learning and also to create a repository of values to serve as a running history. Datasets can thus be used as training sets to train shearing head 140 actuation to more closely assemble to a desired output. By utilizing machine learning, shear heads 140 can be more accurately actuated over time. In such an aspect, machine learning will allow actuation that more closely adheres to the shearing requirements for the various patterns and designs of produced textiles. These patterns and designs are associated with stock keeping units (SKUs), as previously discussed. This will decrease any possible mistakes and lower required human interaction in the shearing process. After shearing is completed, quality testing via visual inspection or sampling of a product occurs to ensure that the product is satisfactory.

As discussed above, multiple shearing heads can be utilized, according to a method 500 shown FIG. 7. Upon approaching a shear head, a pile height sensor reading of the carpet occurs (step 510). From here, the pile height sensor sends the captured measurement to a control unit (step 520). Upon receiving the information, the control unit calculates the needed shear head positioning (step 530). This adjustment can then be stored in a database (step 535) for later purposes as discussed above. Once the height calculation is determined, the calculation is fed to a motor subsystem (e.g., servo motors) (step 540). The motor subsystem then actuates the shear head to the correct position and shearing occurs (step 550). An additional pile height sensor takes a measurement of the new height of sheared carpet (step 560). This measurement is then fed to a control unit to determine whether or not the carpet is at the desired end height (i.e., the height required for the end product) (step 570). If the product is still higher than the desired height (step 580), the system calculated the shear head position of the next shear head (step 530). If the height of the carpet is at or lower than the desired height (step 590), the carpet is fed through the system without additional shearing (Step 595).

Although several aspects have been disclosed in the foregoing specification, it is understood by those skilled in the art that many modifications and other aspects will come to mind to which this disclosure pertains, having the benefit of the teaching presented in the foregoing description and associated drawings. It is thus understood that the disclosure is not limited to the specific aspects disclosed hereinabove, and that many modifications and other aspects are intended to be included within the scope of any claims that can recite the disclosed subject matter.

It should be emphasized that the above-described aspects are merely possible examples of implementations, merely set forth for a clear understanding of the principles of the present disclosure. Any process descriptions or blocks in flow diagrams should be understood as representing modules, segments, or portions of code which comprise one or more executable instructions for implementing specific logical functions or steps in the process, and alternate implementations are included in which functions may not be included or executed at all, can be executed out of order from that shown or discussed, including substantially concurrently or in reverse order, depending on the functionality involved, as would be understood by those reasonably skilled in the art of the present disclosure. Many variations and modifications can be made to the above-described aspect(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

The invention claimed is:

1. A system for shearing a carpet to a desired height, the system comprising:

A) a moving support on which the carpet is disposed, wherein the moving support moves the carpet along, and wherein the carpet is placed onto the moving support at a first height;

B) a plurality of shearing heads positioned along the moving support to cut the carpet to the desired height, each shearing head including a shearing blade;

C) a motor subsystem for each of the plurality of shearing heads, the motor subsystem configured to adjust shearing head height in relation to the carpet;

D) a pile height sensor for each of the shearing heads, the pile height sensor positioned before its associated shearing head along the moving support and configured to measure a height of the carpet before the carpet passes the shearing head; and E) a control unit for each shearing head, the control unit configured to receive the height of the carpet from the pile height sensor and adjust the shearing head height of the shearing head to cut the carpet to the desired height, wherein the control unit is configured to take the measurement captured by each pile height sensor and determine how much to adjust each shearing head to cut the carpet to reach the desired height.

2. The system of claim 1, wherein the motor subsystem comprises two motors, wherein the two motors are placed at ends of the shearing head to adjust the shearing head height.

3. The system of claim 2, wherein the two motors are configured to allow height adjustment of the shearing head by approximately as little as 0.001 mm.

4. The system of claim 2, wherein the two motors are servo motors.

5. The system of claim 1, wherein the system is configured to determine a maximum amount of the carpet to shear within a pass of the shearing head without causing the carpet to melt.

6. The system of claim 5, wherein the control unit is further configured to take the measurement captured by each pile height sensor and determine how much to adjust each shearing head to cut the carpet to reach the desired height in light of the maximum amount.

7. The system of claim 6, wherein the carpet is configured to pass through the system one time to reach the desired height.

8. The system of claim 1, wherein the carpet passes through the system one to three times to shear the carpet to the desired height.

9. The system of claim 1, wherein each pile height sensor associated with each shearing head comprises a pile height sensor positioned before and after each of the shearing heads to measure the entry and exit heights of the carpet before and after each shearing head.

10. The system of claim 9, further comprising a database configured to receive and save the measurements from each of the pile height sensors.

11. The system of claim 1, wherein the control unit compares a measurement received from each pile height sensor to both a maximum allowable shear amount for the carpet and to the desired carpet height in order to adjust the height of the shearing head.

12. A method for shearing carpet to a desired height, the method comprising:

A) feeding the carpet into a system configured to shear the carpet, wherein the system comprises:

I) a moving support; and

II) a shearing head and shearing blade association including a shear head, a shearing blade, a motor subsystem, and a pile height sensor placed in front of the shearing head;

B) taking a first measurement of a height of the carpet, wherein the first measurement is compared to a first value and a second value, wherein the first measurement is determined by the pile height sensor associated with the shearing head;

C) determining an amount to shear from the carpet, wherein the amount is based upon the first measurement of the height and the desired height, wherein the pile height sensor provides the first measurement of the height of the carpet to a control unit configured to determine the amount to shear from the carpet to adjust a shearing head height of the shearing head to cut the carpet to the desired height, wherein the first value is a maximum allowable height of carpet to be removed by the shearing head, and the second value is a remaining height of carpet to be sheared to reach the desired height of the carpet, wherein the amount of carpet determined to be sheared is a minimum of the first value and the second value;

D) providing the determined amount to shear in terms of height to the motor subsystem associated with the shearing head to adjust a height of the shearing blade;

E) adjusting the height of the shearing blade associated with the shearing head; and F) advancing the carpet via the moving support within the system so the shearing blade shears the carpet, wherein the shearing head and shearing blade association comprises a plurality of associations spaced along the moving support, and wherein steps B through E are repeated by advancing the carpet on the moving support until the second value equals zero, and wherein the first value, the second value, and the determined amount to be sheared are stored in one or more databases.

13. The method of claim 12, wherein the determined shear amount is provided to the motor subsystem, wherein the motor subsystem comprises a pair of motors, and wherein the pair of motors actuates one of the shearing heads to adjust the shearing blade height.

14. The method of claim 12, further comprising an additional shearing to the carpet after the desired height of the carpet is reached to achieve a clean finish on the carpet.

15. The method of claim 12, wherein each motor subsystem is configured to allow height adjustment of the shearing head by approximately 0.001 mm.

16. The method of claim 12, wherein the control unit is configured to determine a maximum amount of the carpet to shear within a pass of the shearing head without causing the carpet to melt during shearing.

17. The method of claim 12, wherein the carpet is passed through the system one time to reach the desired height.

18. The method of claim 12, wherein the carpet passes through the system one to three times to reach the desired height of the carpet as a final product.

19. The method of claim 12, further comprising saving the measurements to a database.

20. The method of claim 12, wherein prior to providing the desired height, selecting the desired height based upon a design appearance for the carpet as a final product.

21. A system for shearing a carpet to a desired height, the system comprising:

A) a number of rollers on which the carpet is disposed, wherein the carpet moves along the number of rollers, and wherein the carpet is placed onto the number of rollers at a first height;

B) at least three shearing heads positioned along the number of rollers to cut the carpet to the desired height;

C) at least three motor subsystems configured to adjust shearing head height in relation to the carpet, wherein each motor subsystem comprises at least two motors;

D) a plurality of pile height sensors comprising a first pile height sensor positioned along the number of rollers before a first shearing head configured to measure the first height of the carpet and a number of additional pile height sensors positioned further along the number of rollers to measure the carpet height before and after each shearing head;

E) a database configured to receive and store the measurements from the plurality of pile height sensors; and F) at least three control units each configured to receive a height of the carpet from one of the plurality of pile height sensors and to determine an amount to shear from the carpet by adjusting a shearing head height of one of the at least three shearing heads to cut the carpet to the desired height.

22. The system of claim 21, wherein at least two of the at least three shear heads are configured to substantially shear the carpet to reach the desired height, and wherein substantially shearing the carpet comprises any shearing more substantial than a shear intended to provide the carpet a clean finish.

23. A method for shearing a carpet to a desired height, the method comprising:

A) providing the desired height to a control unit associated with a carpet shearing system;

B) feeding the carpet into the carpet shearing system by placing the carpet on a moving support configured to carry the carpet through the system;

C) taking a first height measurement of piles of the carpet at a first pile height sensor, the first pile height sensor positioned in front of a first shearing head;

D) determining, via the control unit, a first height amount to shear from the piles of the carpet, wherein the first height amount is based upon the first height measurement, the desired height, and a maximum cut amount of the piles of the carpet piled to avoid melting of piles of the carpet when sheared;

E) using the first height amount, by the control unit, to adjust via a motor associated with the first shearing head, a shearing blade to a height so that the first shearing blade will remove the first height amount from the piles of the carpet upon passing the first shearing head;

F) advancing the carpet within the system so the first shearing blade shears the carpet;

G) taking a second height measurement of the piles of the carpet after passing through the first shearing blade;

H) determining, via the control unit, whether the second height measurement equals the desired height; and I) repeating steps D through H while the second height measurement is greater than the desired height until the second height measurement equals the desired height.

24. The method of claim 23, wherein repeating septs D through I are done through one pass through the carpet shearing system.

25. The method of claim 23, wherein prior to shearing the piles of the carpet, applying oil to the shearing blade via an oiler to prevent overheating.

26. The method of claim 23, wherein, prior to providing the desired height, selecting the desired height based upon a design of a final product for the carpet.

27. A method for shearing a carpet to a desired height, the method comprising:

A) selecting the desired height based upon a final design for the carpet, wherein the desired height determines a design feature of the carpet after shearing;

B) feeding the carpet into a system configured to shear the carpet;

C) taking a first measurement of a height of the carpet;

D) determining an amount to shear from the carpet, wherein the amount is based upon the first measurement of the height, a maximum allowable height of carpet to be removed by an individual shearing head with a shearing blade, and a remaining height of carpet to be sheared to reach the desired height, wherein the determined amount being a minimum of the maximum allowable height and remaining height of carpet to be sheared;

E) providing the determined amount to shear in terms of height to a motor to adjust a height of the shearing blade of the shearing head;

F) adjusting the height of the shearing blade;

G) advancing the carpet within the system so the shearing blade shears the carpet; and H) repeating steps C and G until the desired height is reached, wherein the individual shearing head and blade comprise a plurality of shearing head and shearing blade associations spaced along the system, wherein each of the associations comprises a pile height sensor placed in front of the shearing head and is configured to capture the height of the carpet.

* * * * *